US006805066B2

(12) United States Patent
Johnson

(10) Patent No.: US 6,805,066 B2
(45) Date of Patent: Oct. 19, 2004

(54) MODULAR FLOATING SWIM PLATFORM

(75) Inventor: David Johnson, White Salmon, WA (US)

(73) Assignee: North Sports, U.S.A., White Salmon, WA (US)

( * ) Notice: Subject to any disclaimer, the term of this patent is extended or adjusted under 35 U.S.C. 154(b) by 0 days.

(21) Appl. No.: 10/619,655

(22) Filed: Jul. 14, 2003

(65) Prior Publication Data

US 2004/0058599 A1 Mar. 25, 2004

Related U.S. Application Data

(60) Provisional application No. 60/412,264, filed on Sep. 20, 2002.

(51) Int. Cl.[7] ..... B63B 35/44
(52) U.S. Cl. ..... 114/266; 441/35; 441/129
(58) Field of Search ..... 441/32, 34, 40, 441/129, 136; 114/266

(56) References Cited

U.S. PATENT DOCUMENTS 1,603,465 A * 10/1926 Hopkinson ..... 156/65
3,332,094 A * 7/1967 Egbert ..... 441/35
6,135,045 A * 10/2000 Staff ..... 114/266
6,475,048 B2 * 11/2002 Gredy ..... 441/129

* cited by examiner

*Primary Examiner*—Jesus D. Sotelo
(74) *Attorney, Agent, or Firm*—Garrison & Associates PS; David L. Garrison; William L. Haynes

(57) ABSTRACT

A floating platform that has a flat low profile for use by swimmers, divers, boaters, and those engaged in other activities on water. The platform is used alone or as a module in combination with other such floating platform modules; attaching the modules to form a larger floating platform. In a preferred embodiment, the surface of the platform is provided with several connection points enabling multi-point attachment to other vessels and stationary objects, anchor straps and towing straps, and apertures configured to accommodate beverage containers, coolers, chairs, umbrellas, retractable tops and the like. In another embodiment, a detachable cover is attached to the module, the cover forming the floating platform surface. A stable platform and low profile are achieved through use of stiffeners integrated within the platform surface.

23 Claims, 6 Drawing Sheets

MODULAR FLOATING SWIM PLATFORM

CROSS-REFERENCE TO RELATED APPLICATION

This application claims the benefit of U.S. Provisional Application Ser. No. 60/412,264, entitled Modular Floating Swim Platform, filed Sep. 20, 2002.

FIELD OF THE INVENTION

This invention relates to floating structures, and more particularly to modular floating structures that may be used alone or interconnected with a plurality of similar modular units to form varying sizes of floating structures for various applications.

BACKGROUND OF THE INVENTION

It is well known to utilize inflatable structures as platforms for use by swimmers, boaters and the like. These structures usually come in a set size which cannot be varied and which must rely on the integral structural aspects in order to provide stability.

U.S. Pat. No. 2,888,690 features the use of a watertight rigid frame constructed of wood or sheet metal that has a central main body portion, with outrigged floatation units. This raft is not collapsible or capable of being stowed in a relatively small area.

U.S. Pat. No. 3,950,804 (1976) teaches a collapsible raft that makes use of rigid hull and deck members. While this raft is collapsible, its rigid members hinder the ability to stow the collapsed raft in a small enclosure.

U.S. Pat. No. 4,727,820 (1988) teaches a floating dock for a small vessel that may be attached to other buoyant members to form a larger polygonal floating dock. This invention is limited to triangular shaped buoyant members with indentations to receive the nose of a small vessel. However, such a device would be suitable for applications other than mooring small vessels.

None of the above prior art suggests a floating platform for a variety of water applications that can be used either independently or readily connected with other similar platforms to create a larger floating platform.

It is also known to gang together a plurality of floating structures to provide a larger surface area. However, prior devices have suffered from having the intersection between adjacent floating structures present difficulties because of the lack of structural integrity among adjacent floats. Frequently, safety hazards result when two or more floating units are connected together and used as a platform, especially when the floating units are not designed to nest together (e.g., round or elliptical-shaped rafts). There is clearly a need for a floating structure which may be used individually or which may be readily ganged together with a structural connection that provides structural integrity from one floating unit to another.

Most floating platforms intended for use by swimmers are significantly thick or sit high in the water necessitating the use of a ladders for personal access. Also, a larger floating structures assembled from multiple smaller modular floating units would have a tendency to be less stable given the movement of the water.

Most floating structures that have a more rigid surface are not readily portable. Wooden swimming rafts and docks must remain for the most part in a fixed location. The utility of a floating structure is improved if the floating structure can readily be moved to a desired location and secured in position, or easily relocated as necessary.

Many people enjoy social activities on water with a need for accommodations for food, beverages, shade, supplies and appliances to be stowed or mounted safely and in a stable manner.

BRIEF SUMMARY OF THE INVENTION

It is therefore an object of the present invention to provide a modular floatable structure for use by swimmers and for other various applications that may be used alone or as a module connected with one or more other modules in linear or rectangular configurations to form a larger floatable structure. It is a further object of the present invention to provide a floating structure that may be made of one or more modular units in which the surface of the structure utilizes stiffeners to add to the dimensional and structural integrity of the unit, thus providing improved stability and a low profile relative to the water's surface.

Each floatable module of the present invention is a substantially planar structure in the shape of a square or rectangle and is made up of one or more inflatable bladders to provide floatation, and an upper surface or cover system that may incorporate stiffening means, such as a plastic or wood deck. The ability to inflate and deflate the module allows the device to be stowed in a small container and then opened up and inflated to form a semi-rigid floating platform when and where desired. Inflatable internal beams are integrated within the bladders to provide longitudinal strength, stability and a low profile. This low profile enables ease of access to passengers and occupants without the need for a ladder.

The utility of a floating platform would be greatly improved if it provided for the various amenities and necessities of individuals recreating on the water. Accordingly, it is an object of this invention to provide a floating platform that has a variety of structural provisions to accommodate accessory items such as coolers, chairs, umbrellas, retractable shade tops, and the like. Surface fittings are provided in a preferred embodiment of the present invention on either the module surface or the cover to attach accessory items such as coolers, chairs, umbrellas, retractable shade tops, and the like. The floatable module also has reinforced corner strap by which the module may be towed by its corner, thus minimizing the resistance of the water, and anchored in a desired location. The module may also be self-propelled using an electric or gas motor that is attached to an optionally affixed motor mount on a corner of the module. Oar locks arranged on the deck surface would enable the floatable module to be rowed.

Various other purposes and advantages of the invention will become clear from its description in the specification that follows, and from the novel features particularly pointed out in the appended claims. Therefore, to the accomplishment of the objectives described above, this invention consists of the features hereinafter illustrated in the drawings, fully described in the detailed description of the preferred embodiments and particularly pointed out in the claims. However, such drawings and description disclose only some of the various ways in which the invention may be practiced.

DETAILED DESCRIPTION OF THE INVENTION

Figure 1:
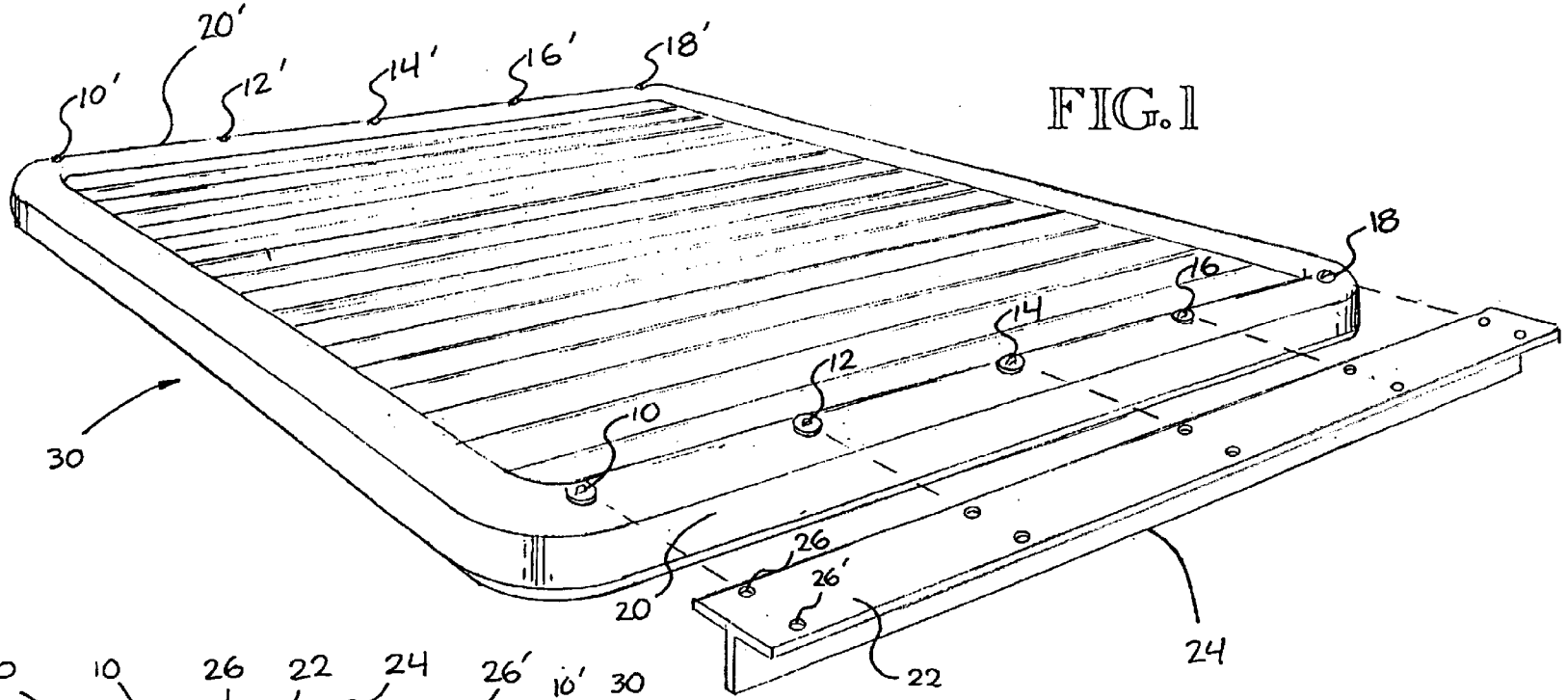
FIG. 1 is a perspective view of a floatable platform showing the location of connectors along the top edges, and a member to provide structural stiffening between adjoining floatable platforms.
Figure 2:
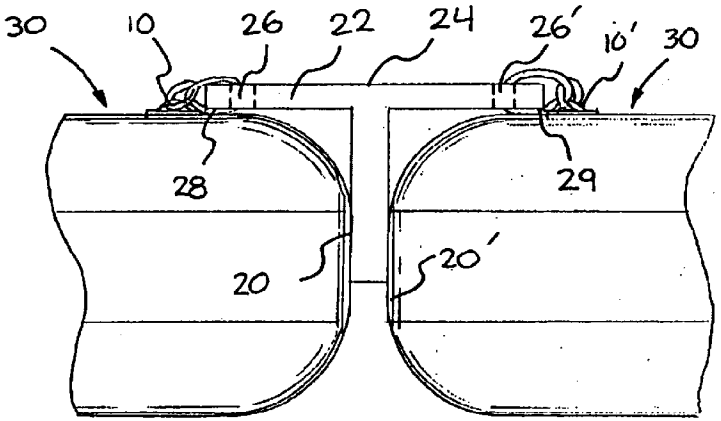
FIG. 2 is a cross sectional view of a member to provide structural stiffening, shown connected between adjoining floatable platforms.

Referring to the attached drawings, FIG. 1 shows a single inflatable module 30, such as may be used in the practice of this invention, which constitutes a substantially square shape in plan view, and has a vertical dimension established by the height of the inflatable bladders or chambers used. The inflatable module 30 has connectors (such as D-rings) affixed along the outside edges of the module to enable multi-point attachment to adjacent modules, other water vessels, or fixed objects. The connectors are positioned along edges of the inflatable module 30 at locations 10, 10', 12, 12', 14, 14', 16, 16', 18 and 18' as shown in FIG. 2. Attachment is made using connector devices such as webbing straps, ropes, caribiners, snap locks and the like. In a preferred embodiment, the connector means is a system of stainless D-rings and several layers of fabric PVC-welded together to make a strong connection.

Alternative means of connecting the inflatable modules 30 together may include interengaging means positioned at intervals along the sides 20 and 20' of the module shown in FIG. 2. For example, zipper structures could be placed top and bottom, velcro-typed fasteners could be utilized, all of which are designed to provide a structural inter-engagement between adjacent inflatable modules.

FIG. 1 and FIG. 2 illustrate an embodiment of an interengaging means for attaching adjacent floatable modules. FIG. 1 and FIG. 2 show a plastic rail structure 24 formed in a "T" cross-section and used to provide structural stiffening between adjoining inflatable modules 30. The horizontal portion 22 of the connector shown in FIG. 1 and FIG. 2 has apertures 26 and 26' positioned therein to receive the connector devices along the floatable platform edges. FIG. 2 is a cross-sectional view of the structural stiffening structure 24 shown in place between two adjoining inflatable modules 30 and 30' attached to fastener fittings 10, 12, 14, 16, 18 or 10', 12', 14', 16', and 18', by reinforced web straps 28 and 29 extending through apertures 26 and 26' of structural stiffening structure 24.

Figure 3:
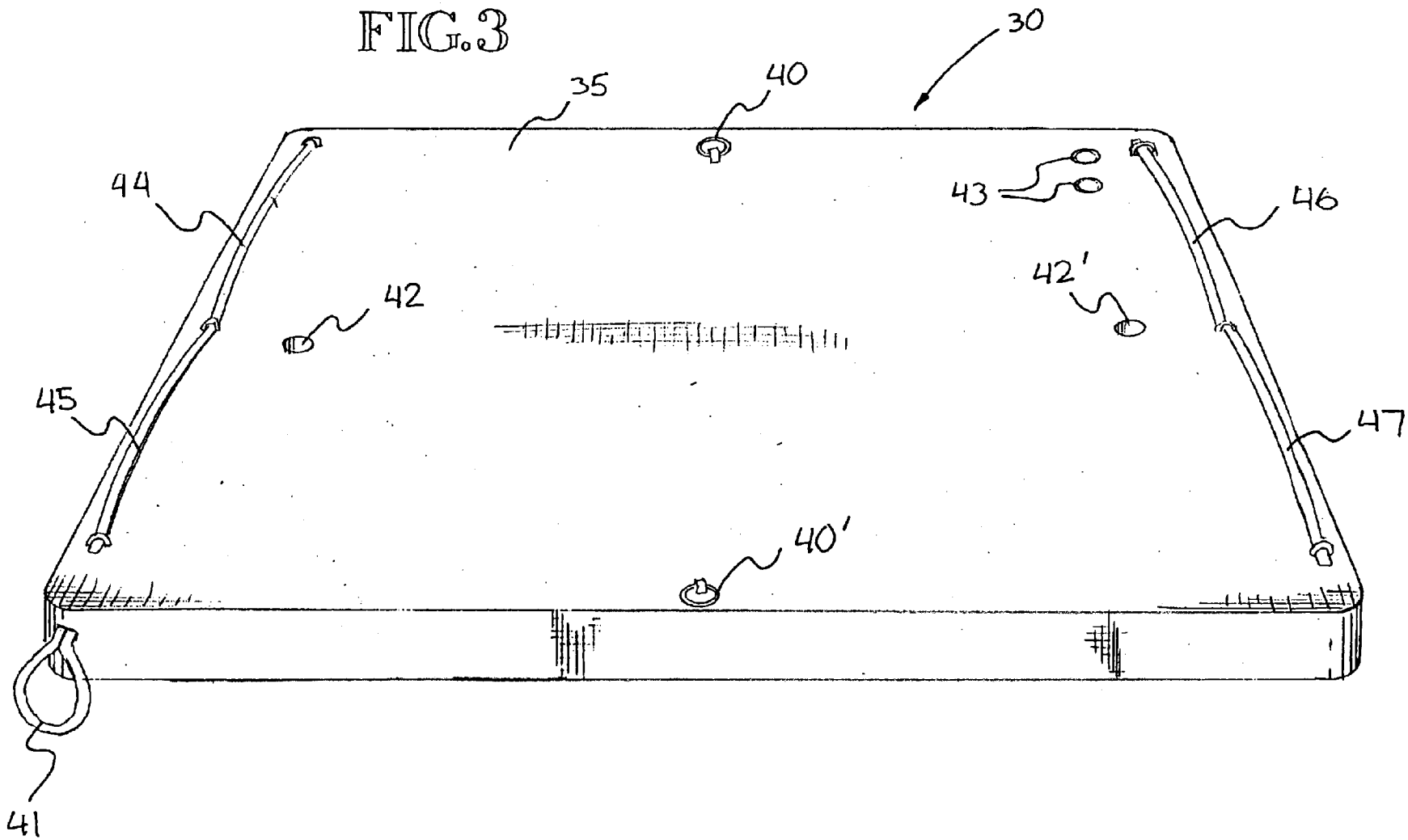
FIG. 3 is a perspective view of the present invention as seen from above and from one end.

FIG. 3 illustrates a preferred embodiment of a single inflatable module 30. An external surface cover structure 35 is shown covering the module whereby a deck surface is formed. 40 and 40' are stainless steel mooring rings provided so that the module is releasably engagable with additional modules, boats, other vessels, and anchoring devices. A reinforced towing strap 41 is secured to one corner of the floatable module to allow the floating platform to be towed or to be attached to an anchor to secure the floating platform in a fixed location. The towing strap is attached to the floatable module using webbing straps that spread the load of towing over a broad area of the module's surface.

Apertures 42 and 42' are provided within the top of the floatable platform to securely hold cylindrical beverage containers such as bottled and canned drinks, and are located to optimize ease of use and enjoyment by users. Similar additional apertures may be provided in a wide variety of configurations to receive accessory items such as beverage containers, coolers, chairs, umbrellas, retractable tops and the like. Inflation valves 43 in the form of two recessed Boston valves are located on the surface of the inflatable module in this embodiment (one valve for each of two inflatable bladders used to provide floatation for this embodiment). This embodiment also provides four removable padded swim straps 44, 45, 46 and 47 attached at intervals along the sides of the external surface cover structure 35 that can be adjustable and changed to a variety of configurations, including a towing configuration.

Figure 4:
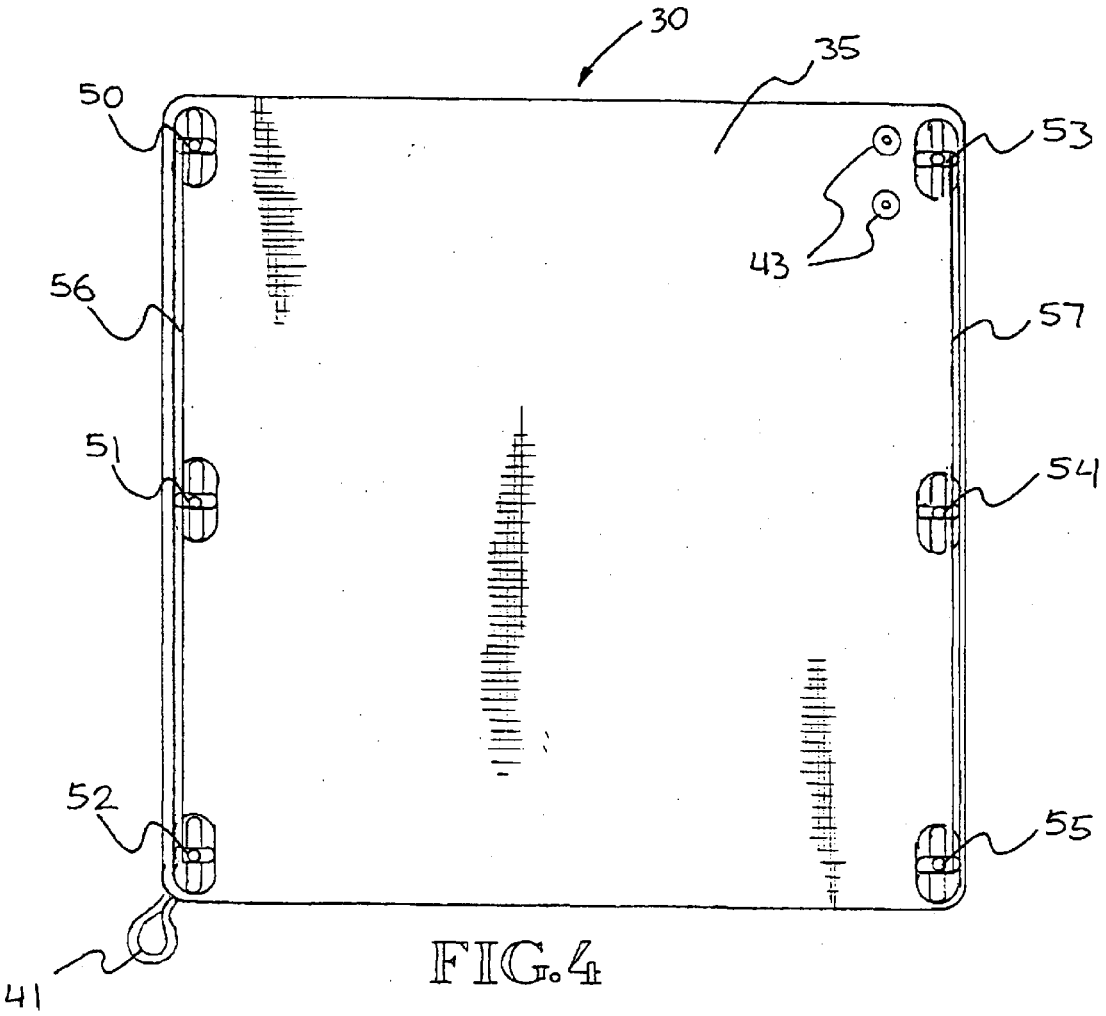
FIG. 4 is a plan view of one embodiment of a floatable platform according to this invention.

FIG. 4 illustrates another embodiment showing the location of oar locks 50, 51, 52, 53, 54 and 55 located at intervals along the top of the surface cover structure 35, and two ropes 56 and 57 attached to the top of the surface cover structure and extending along opposite sides of the inflatable module. Inflation valves 43 are shown located on one corner. A tow strap 41 is affixed to one corner of the floatable module.

Figure 5:
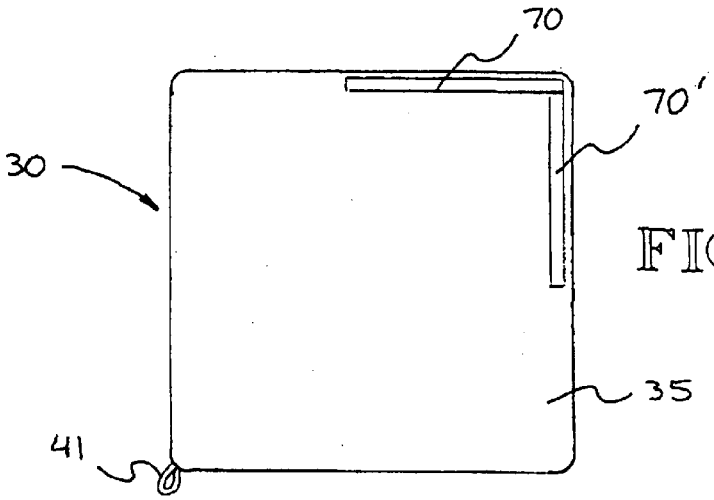
FIG. 5 is a plan view of one embodiment of the present invention to show two mesh drain vents.

FIG. 5 shows the location of two mesh drain vents 70 and 70' in this embodiment to provide a way of draining accumulated water from the top of the surface cover structure 35.

Figure 6:
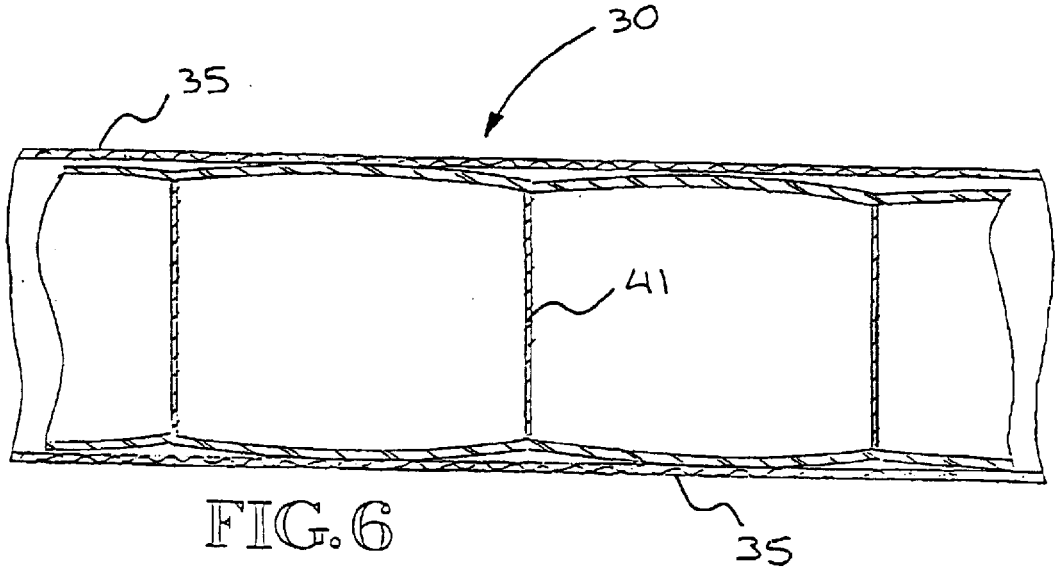
FIG. 6 is a cross section view showing internal I-beam structure and an external cover.

FIG. 6 is a cross section end view of a floatable module showing an internal structure of essentially parallel running I-beam members 41. Inflatable internal beams are integrated within the bladders to provide longitudinal strength, stability and a low profile. This low profile enables ease of access to passengers and occupants without the need for a ladder.

Figure 7:
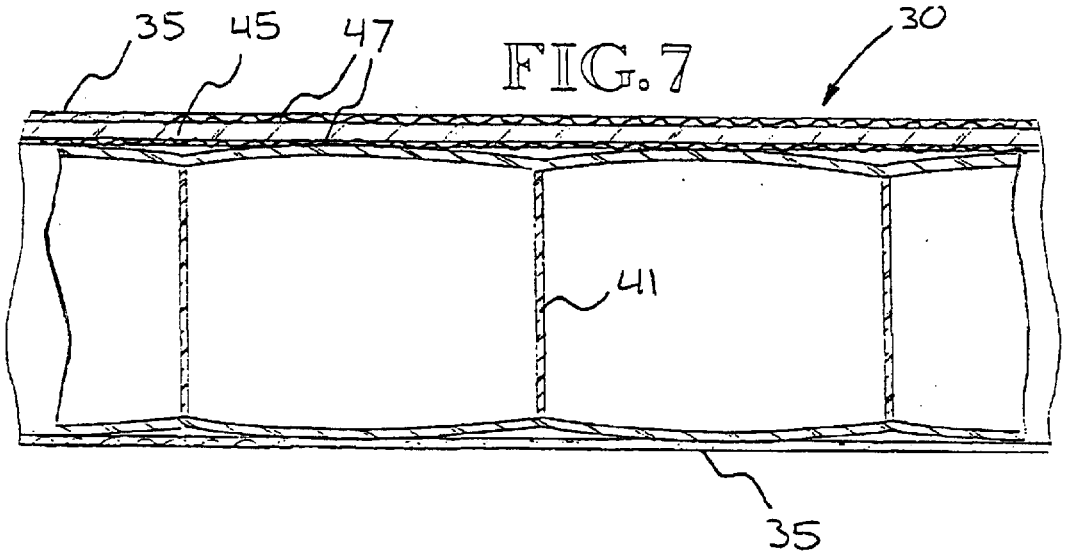
FIG. 7 is a cross section view showing stiffening members integrated within the upper surface of the external cover, and ribs integrated within the bottom of the module.

A flexible, but substantial external cover structure 35 is provided in one embodiment as shown in FIG. 6. FIG. 7 shows another embodiment of an external cover structure that utilizes stiffening means 45, such as a sheet of plywood or rigid plastic, slats or the like embedded within a sealable plastic sleeve 47 and positioned over the top of a floating module 30. The top of the platform stiffened with materials such as plywood or plastic make the platform more rigid and easier to walk across. In an embodiment where an external cover structure is used to cover an array of interconnected modules, the stiffeners or slats are preferably positioned perpendicularly to the joint between adjacent floating modules 30 to provide further structural integrity to the overall array of floating modules.

Figure 8:
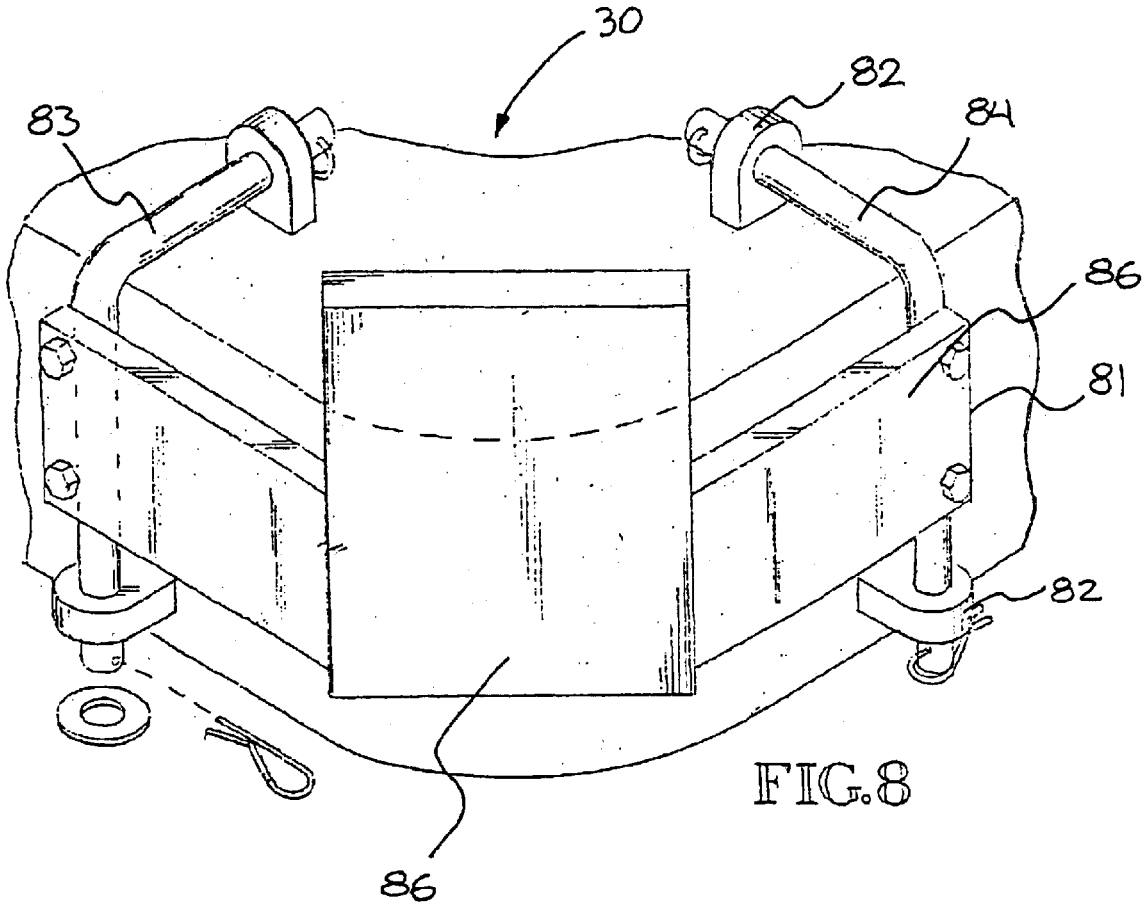
FIG. 8 is a perspective view of the corner detail of a floatable platform showing one embodiment of a motor mount.

FIG. 8 illustrates one embodiment of a reinforced motor mount assembly 81 releasably attached to a corner of a floating module 30. Reinforced tabs 82 are integrated within the top and side surfaces of the floating module and receive bracket arms 83 and 84, which are secured by a fastener system 85, such as washers and retaining clips. A corner bracket 86 is attached to the vertical portions of bracket arms 83 and 84 with common fasteners. A transom plate is attached to the corner bracket 86 to provide a mount for a small gas or electric motor.

Figure 9:
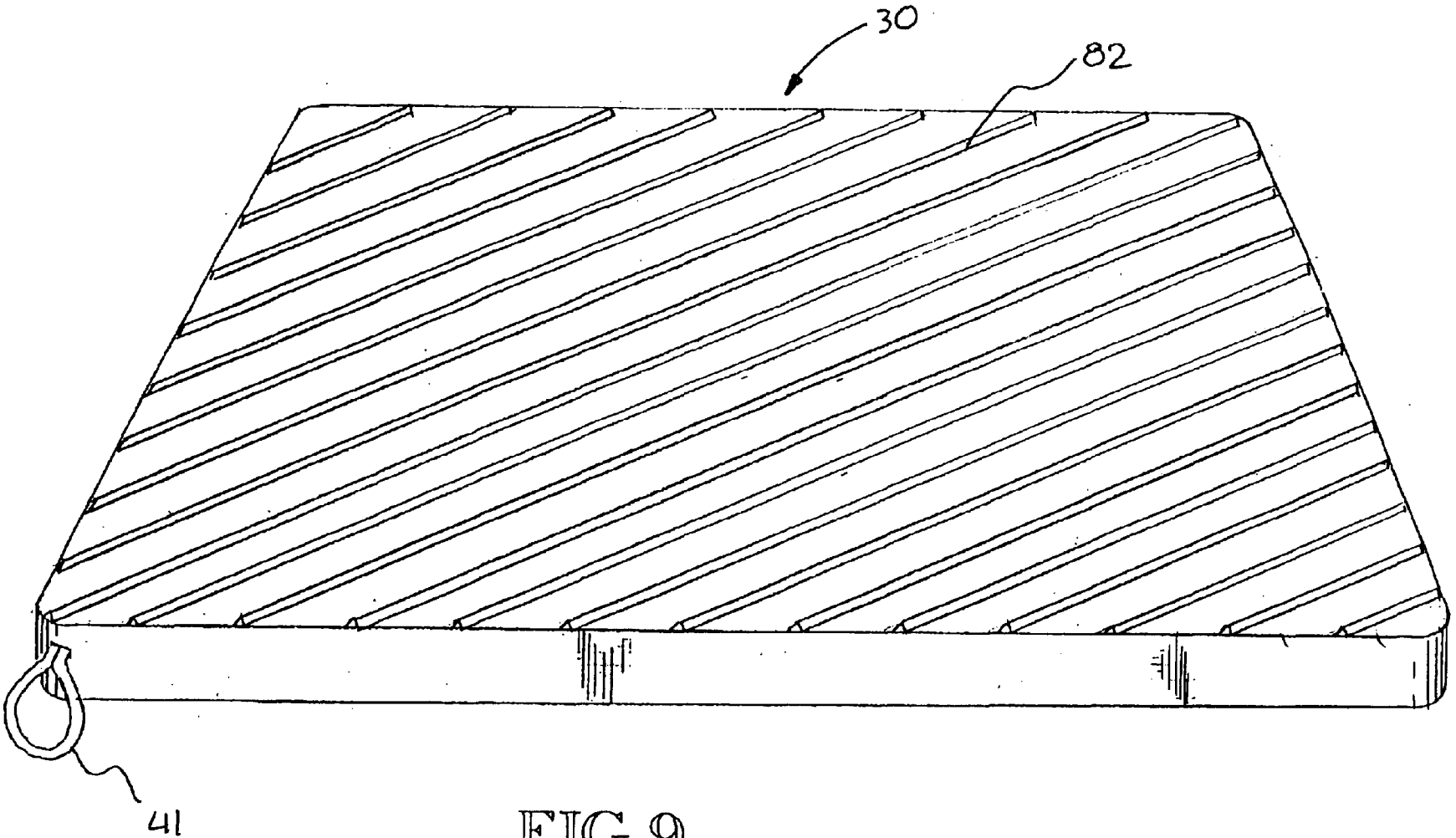
FIG. 9 is a perspective view of the bottom of the present invention as seen from one end.

FIG. 9 illustrates a plurality of essentially parallel longitudinal ribs integrated within the bottom of the module 30. In this embodiment, the ribs are arranged diagonally with respect to the sides, and run in the intended direction of travel when the floating module is towed or self-propelled, thus providing added stability of travel in water. Ribs arranged in this manner also provide cross-directional reinforcement further enhancing the overall structural integrity of the module and further enabling a low-profile construction.

INDUSTRIAL APPLICABILITY

The invention has applicability to the field of floating structures, and more particularly to low-profile modular floating structures that may be assembled in varying sizes for various applications by connecting together a plurality of square modular units; having surface fittings for attachment of devices such as coolers, chairs, umbrellas, retractable shade tops, and the like; and having structural accommodations by which the floating structure may be towed by and anchored or self-propelled.

In compliance with the statute, the invention has been described in language more or less specific as to structural features. It is to be understood, however, that the invention is not limited to the specific features shown or described, since the means and construction shown or described comprise preferred forms of putting the invention into effect., Additionally, while this invention is described in terms of being used with modular floating structures, it will be readily apparent to those skilled in the art that the invention can be adapted to other uses for other floating platforms as well, and therefore the invention should not be construed as being limited to modular floating. The invention is, therefore, claimed in any of its forms or modifications within the legitimate and valid scope of the appended claims, appropriately interpreted in accordance with the doctrine of equivalents.

I claim:

1. A device for use as a floatable platform comprising:

a substantially planar module having a substantially flat top deck surface, a bottom, and an exterior edge defining the perimeter of the module;

one or more inflatable bladders defining the bottom and the perimeter of the module, each bladder having a top, a bottom, an exterior edge defining the perimeter of the bladder, an outside surface, and an inside surface, each said inflatable bladder further comprising an inflation valve and a plurality of substantially parallel longitudinal I-beam members integrated within said bladders and adjoining the top and bottom of the inside surface of the bladder; and a plurality of connectors affixed to the exterior edge of the module, whereby the module is releasably engagable with additional modules, fixed objects, boats, other vessels, and anchoring devices.

2. The device of claim 1 having a ratio of thickness to top surface area of less than 1:640.

3. The device of claim 1 having a thickness of 8 inches or less.

4. The device of claim 1, further comprising a reinforced strap affixed to a corner location along the exterior edge of the module, whereby the module is towable from one corner.

5. The device of claim 1, further comprising a plurality of apertures located within the top deck surface to receive releasably attachable accessory items comprising beverage containers, coolers, chairs, umbrellas, retractable tops and the like.

6. The apertures of claim 5, further comprising a plurality of shaped receptacles to receive releasably attachable accessory items comprising beverage containers, coolers, chairs, umbrellas, and retractable tops.

7. The exterior edge of claim 1, further comprising at least four substantially flat sides along the perimeter of the module, whereby the module is attachable to at least one additional module in linear and rectangular configurations.

8. The device of claim 1, further comprising a plurality of stiffening members integrated within said top deck surface.

9. The device of claim 8, wherein said stiffening members comprise plywood sheets.

10. The device of claim 9 wherein said plywood sheets are sealed inside a foldable, sealable plastic sleeve.

11. The device of claim 8 wherein said stiffening members comprise rigid plastic sheets.

12. The device of claim 1, further comprising an external cover having a substantially flat upper surface, a bottom, an exterior edge defining the perimeter of the module, and a plurality of connectors affixed to the exterior edge of the external cover, whereby the external cover is releasably attachable to the top of the module.

13. The device of claim 12, further comprising at least one fluid permeable element integrated within the upper surface of the external cover such that water drainage is facilitated.

14. The device of claim 12, further comprising stiffening members integrated within the upper surface of the external cover, whereby the top deck surface of the module is defined by the upper surface of the external cover.

15. The device of claim 14 wherein said stiffening members comprise plywood sheets.

16. The device of claim 15 wherein said plywood sheets are sealed inside a foldable, sealable plastic sleeve.

17. The device of claim 14 wherein said stiffening members comprise rigid plastic sheets.

18. The device of claim 1, wherein the exterior edge defining the perimeter of the module is square-shaped, whereby the module is attachable to at least one additional module in linear and rectangular configurations.

19. The device of claim 1, further comprising a plurality of essentially parallel longitudinal ribs integrated within the bottom of the module.

20. The device of claim 1, further comprising a reinforced motor mount affixed to a corner of the module.

21. The top deck surface of claim 1, further comprising at least one pair of apertures configured to receive oar locks.

22. A floatable platform comprising:

one or more independently buoyant modules releasably and flexibly connected to one another to form a single structure, wherein each module comprises a substantially planar module having a substantially flat top deck surface, a bottom, and at least four substantially flat sides forming an exterior edge defining the perimeter of the module;

a plurality of stiffening members integrated within said top deck surface;

at least two inflatable bladders defining the bottom and the perimeter of the module, each bladder having a top, a bottom, an exterior edge defining the perimeter of the bladder, an outside surface, and an inside surface, each said inflatable bladder further comprising an inflation valve and a plurality of substantially parallel longitudinal I-beam members integrated within said bladders and adjoining the top and bottom of the inside surface of the bladder;

a plurality of connectors affixed to the exterior edge of the module, whereby the module is releasably engagable with additional modules, fixed objects, boats, other vessels, and anchoring devices;

a reinforced strap affixed to a corner location along the exterior edge of the module, whereby the module is towable from one corner; and a plurality of apertures located within the top deck surface to receive releasably attachable accessory items comprising beverage containers, coolers, chairs, umbrellas, retractable tops and the like.

23. The floatable platform of claim 22 further comprising a plurality of module interface members, each member having a first end, a second end, a top, a bottom, a T-shaped cross-section, and a plurality of apertures arranged at intervals along the top of the member, whereby members are releasably attachable to the exterior edge connectors of each module, thereby providing structural integrity to the union of two adjoined floating modules.

* * * * *